US007056079B2

(12) United States Patent
Branham et al.

(10) Patent No.: US 7,056,079 B2
(45) Date of Patent: Jun. 6, 2006

(54) LINKAGE ASSEMBLY RESTRAINT

(75) Inventors: Dana D. Branham, Garner, NC (US); Andy R. Fowkes, Clayton, NC (US); Robert W. Hunter, Jr., Wake Forest, NC (US); Paul E. Pottschmidt, Apex, NC (US)

(73) Assignee: Caterpillar Inc., Peoria, IL (US)

( * ) Notice: Subject to any disclaimer, the term of this patent is extended or adjusted under 35 U.S.C. 154(b) by 67 days.

(21) Appl. No.: 10/705,343

(22) Filed: Nov. 10, 2003

(65) Prior Publication Data

US 2005/0111951 A1 May 26, 2005

(51) Int. Cl.
*B66C 23/00* (2006.01)

(52) U.S. Cl. ..... 414/680; 414/912

(58) Field of Classification Search ..... 414/680, 414/912; 172/466, 481
See application file for complete search history.

(56) References Cited

U.S. PATENT DOCUMENTS

| | | | | |
|---|---|---|---|---|
| 3,248,864 | A | | 5/1966 | Barth |
| 3,757,642 | A | | 9/1973 | Schuermann |
| 3,918,601 | A | * | 11/1975 | Zimmerman ..... 414/713 |
| 3,955,851 | A | | 5/1976 | Umeda et al. |
| 4,039,093 | A | * | 8/1977 | Schmitz et al. ..... 414/680 |
| 4,061,353 | A | | 12/1977 | Kingman et al. |
| 4,141,257 | A | | 2/1979 | Hammond et al. |
| 4,221,353 | A | | 9/1980 | Kuhn et al. |
| 4,241,565 | A | | 12/1980 | Parsons, Jr. |
| 4,265,587 | A | | 5/1981 | Clark |
| 4,427,154 | A | | 1/1984 | Mercil |
| 4,493,426 | A | | 1/1985 | Sterner |
| 4,502,269 | A | | 3/1985 | Cartner |
| 4,598,830 | A | | 7/1986 | Fletcher |
| 4,636,132 | A | | 1/1987 | Menke et al. |
| 4,720,234 | A | | 1/1988 | Stralow |
| 4,869,056 | A | | 9/1989 | Lynch |
| 4,887,938 | A | | 12/1989 | Menke |
| 4,944,649 | A | | 7/1990 | Stralow |
| 4,960,359 | A | | 10/1990 | Lovitt, Jr. |
| 5,064,339 | A | | 11/1991 | Ahlers |
| 5,065,566 | A | | 11/1991 | Gates |
| 5,152,659 | A | | 10/1992 | Waka |
| 5,169,277 | A | | 12/1992 | Orser et al. |
| 5,210,997 | A | | 5/1993 | Mountcastle, Jr. |
| 5,292,220 | A | | 3/1994 | Cartner |
| 5,341,629 | A | | 8/1994 | Penner |
| 5,419,104 | A | | 5/1995 | Higdon |
| 5,435,117 | A | | 7/1995 | Eggena |
| 5,794,852 | A | | 8/1998 | Wald et al. |
| 5,850,704 | A | | 12/1998 | Harinen |
| 5,967,737 | A | | 10/1999 | Kraske et al. |
| 6,336,565 | B1 | | 1/2002 | Merkel et al. |

* cited by examiner

*Primary Examiner*—Donald W. Underwood
(74) *Attorney, Agent, or Firm*—Finnegan,Henderson,Farabow,Garrett&Dunner LLP

(57) ABSTRACT

Work machines having linkages may need to have the linkage assembly locked in a predetermined position to prevent damage to an implement attached to the work machine, to prevent tipping of the work machine, to operate the implement, or other reasons. Locking the linkage assembly, however, can create significant loads on the linkage assembly. The disclosed method and apparatus is for a work machine that comprises a chassis, at least one linkage assembly attached to the work machine, at least one restraint having a first-end portion and a second-end portion, the second-end portion being attached to the chassis and the first-end portion being attached to the linkage assembly, the restraint transferring a load from the linkage assembly to the chassis.

19 Claims, 3 Drawing Sheets

LINKAGE ASSEMBLY RESTRAINT

TECHNICAL FIELD

This invention relates generally to a restraint of a work machine, and, more particularly, to a linkage assembly restraint that transfers a load to a chassis of the work machine.

BACKGROUND

Work machines such as wheeled loaders, integrated tool carriers, and other work machines have linkage assemblies for raising, lowering, and tilting several different types of implements. The linkage assembly may need to be locked in a predetermined position to prevent damage to the implement and prevent tipping of the work machine. A restraint is used to lock the linkage assembly in position preventing it from being raised, lowered, or tilted. Once the linkage assembly is locked in the predetermined position there is a significant amount of load placed on the linkage assembly, links, lift arms, and levers. The load is caused by several factors such as the weight of the implement, the implement's distance from the work machine, and the vibration of the implement as the work machine moves.

One known linkage assembly restraint design is disclosed in U.S. Pat. No. 5,169,277 issued to Orser and Dubé on Dec. 8, 1992. The linkage assembly restraint includes a lock for selectively securing the lift arm to the vehicle body, when the lift arm is lowered. The lock includes a means for releasably and automatically locking the lift arm to the vehicle body at a position remote from the pivot when the lift arm is lowered. This design, however, does not permit a substantial load to be transferred from the lift arm to the chassis of the work machine and may result in significant loads being placed on the lift arm. Additionally, this design does not lock the tilt linkage assembly of the work machine in place and prevent the tilt function.

SUMMARY OF THE INVENTION

In one aspect of the present invention, a work machine comprises a chassis, at least one linkage assembly attached to the work machine, at least one restraint having a first-end portion and a second-end portion, the second-end portion being attached to the chassis and the first-end portion being attached to the linkage assembly, the restraint transferring a load from the linkage assembly to the chassis.

In another aspect of the present invention, a method of restraining at least one linkage assembly of a work machine having a chassis, the method comprises providing at least one restraint having a first-end portion and a second-end portion, moving the linkage assembly of the work machine to a predetermined position, attaching the second-end portion of the restraint to the chassis of the work machine, attaching the first-end portion of the restraint to the linkage assembly, and transferring a load from the linkage assembly to the chassis through the restraint.

BRIEF DESCRIPTION OF THE DRAWINGS

For a better understanding of the present invention, reference may be made to the accompanying drawings in which.

DETAILED DESCRIPTION

Figure 1:
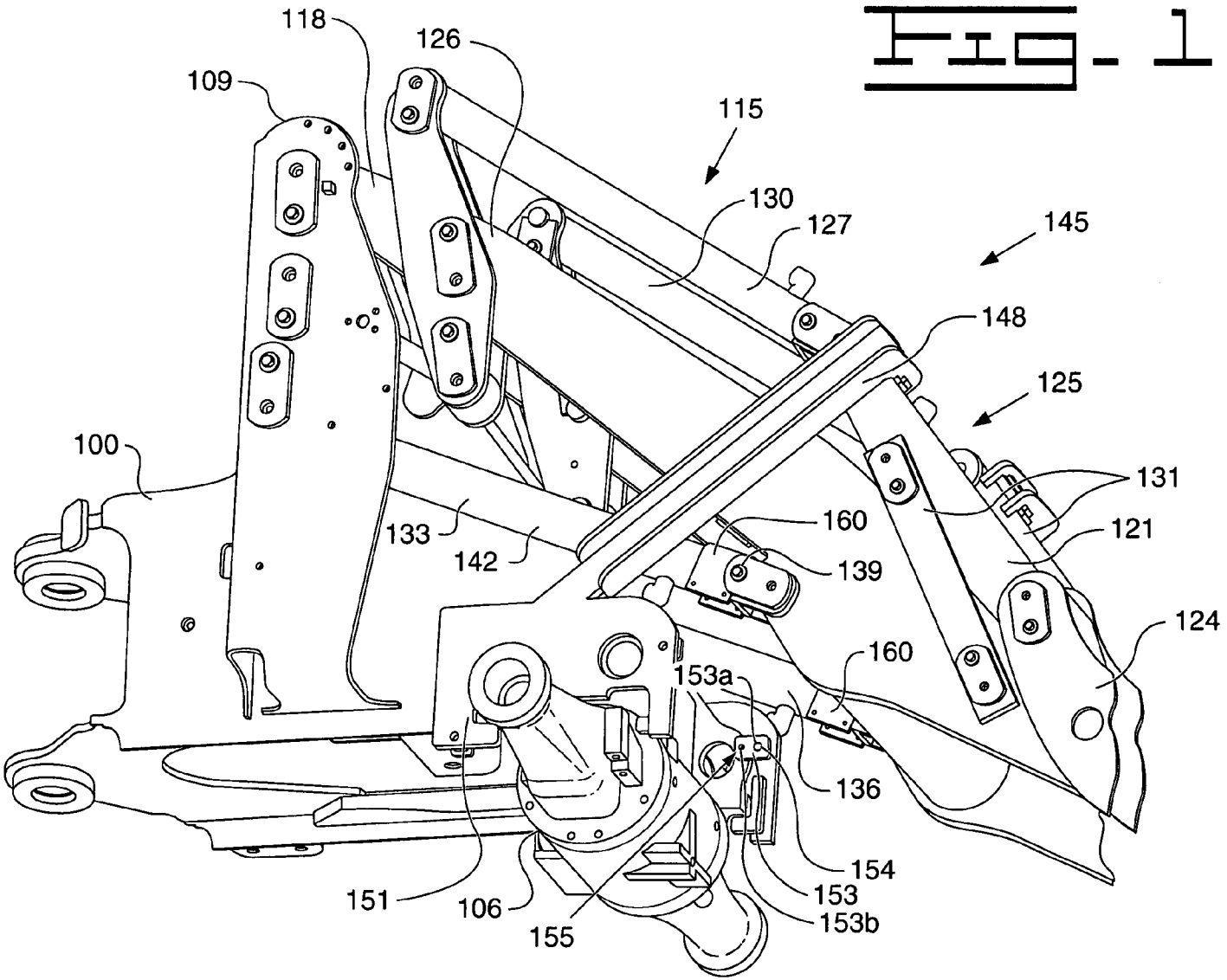
FIG. 1 is a diagrammatic side view of a linkage assembly of a work machine with restraints attached to a chassis and the linkage assembly of the work machine.

Referring to the drawings, depicted in FIG. 1 is a chassis 100 of a work machine (not shown) such as an integrated toolcarrier, a wheel loader, skid steer loader, or other suitable work machine. Front 106 and rear axles (not shown) are attached to the chassis 100. A vertical coupler 109 is attached to each side of the chassis 100 (only one being shown) by such processes as welding, using mechanical fasteners, or another suitable attachment process. Linkage assembly 115 has a first-end portion 118 and a second-end portion 121, has its first-end portion 118 pivotally attached between the vertical coupler 109 by bolting it thereto, and has its second-end portion 121 pivotally connectable to an implement 124 (a portion of which is shown in FIG. 1), such as a mower, bucket, broom, tiller, auger, hammer, shear, or other implement. The linkage assembly 115 includes at least one tilt linkage assembly 125 and at least one lift arm 126. The tilt linkage assembly 125 includes a pair of actuators, such as hydraulic cylinders 127, 130, attached to the linkage assembly 115 so as to rotate the implement 124 relative to linkage assembly 115 and a plurality of other linkages 131. In the embodiment shown, four other linkages 131 are used (only three of which are visible). It should be understood, however, that any number of other linkages may be used.

Referring further to FIG. 1, a pair of actuators, such as hydraulic cylinders 133, 136, each having a rod end 139 and a cylinder end 142, are used to raise and lower the linkage assembly 115, or more specifically, to raise and lower the lift arm 126. The rod ends 139 are attached to the linkage assembly 115 in proximity to the second-end portion 121 of the linkage assembly 115 and the cylinder ends 142 are attached to the vertical couplers 109. Removably attached to the rod end 139 of each of the hydraulic cylinders 133, 136 is a collar 160 that abuts against the cylinder end 142 of the hydraulic cylinders 133, 136 when the linkage assembly 115 is locked in a predetermined position.

Finally, removably attached to the linkage assembly 115, including the tilt linkage assembly 125, and the chassis 100 of the work machine is at least one restraint 145. The restraint 145 has a first-end portion 148 and a second-end portion 151. For exemplary purposes herein, two restraints 145 are shown being utilized herein. The second-end portions 151 of the restraints 145 are removably attached to the chassis 100 of the work machine by using a fastener such as a bracket 153 and a plurality of bolts 154, 155. More specifically, the second-end portions 151 of the restraints 145 are removably attached to that portion of the chassis 100 that comprises the axle 106 using the brackets 153 and the plurality of bolts 154, 155. The brackets 153 have a first side 153*a* and a second side 153*b*. The first sides 153*a* are removably attached to the axle 106 by the use of bolts 154 and the second sides 153*b* are removably attached to the second-end portions 151 of the restraints 145 by the use of bolts 155.

Figure 2:
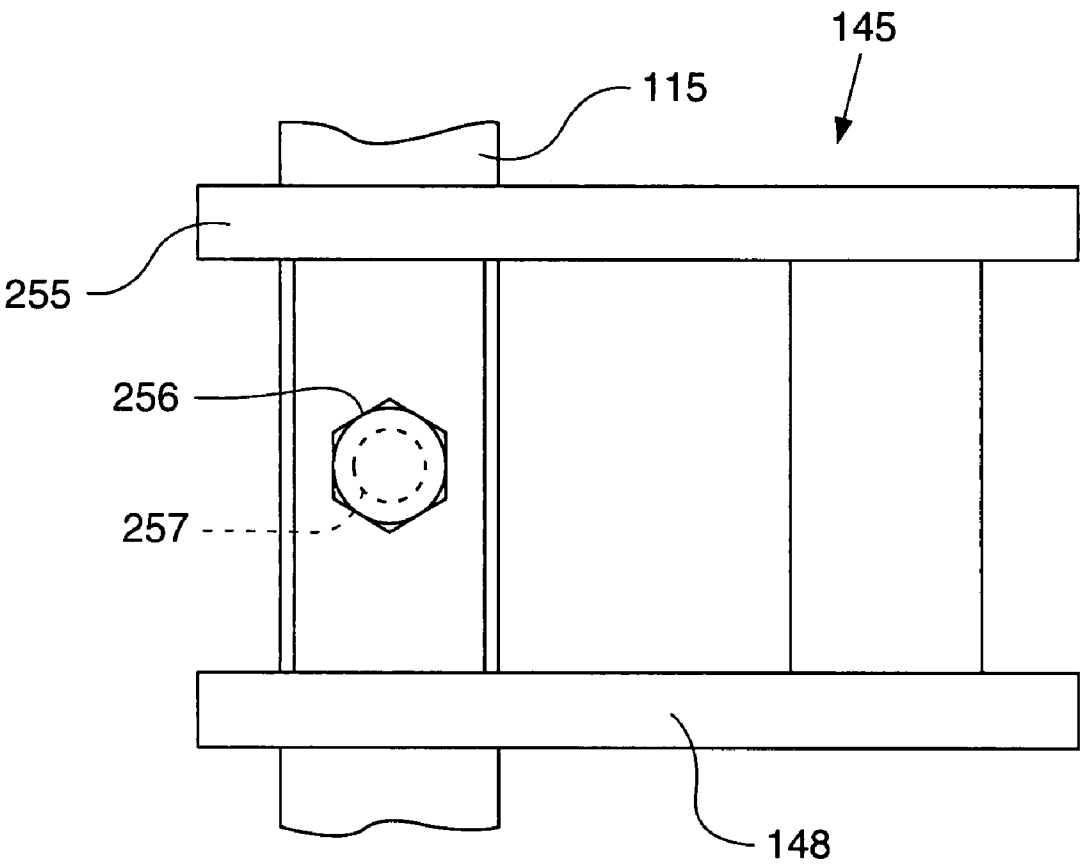
FIG. 2 is a diagrammatic top view of the linkage assembly of the work machine with the restraints attached thereto.

As seen in FIG. 2, the first-end portions 148 of the restraints 145 are removably attached to the linkage assembly 115. The first-end portions 148 each include a hook 255 that fits over the linkage assembly 115 so as to removably attach the first-end portions 148 to the linkage assembly 115.

Each first-end portion 148 further includes an aperture 257 in the hook 255 that is threaded to accept a mating bolt 256. Bolts 256 are threaded through apertures 257 so that the bolts 256 contact the linkage assembly 115. The friction created by the contact of the bolts 256 and the linkage assembly 115 prevents the first-end portions 148 from sliding off the linkage assembly 115 or substantially traveling from their location. Removably attaching the restraints 145 and the collars 160 locks the linkage assembly 115 in the predetermined position and substantially restrains the linkage assembly 115 from traveling from the predetermined position, including up and down travel and tilt. More specifically, the restraints 145 prevent motion of the tilt function and lift function of the linkage assembly 115.

Figure 3:
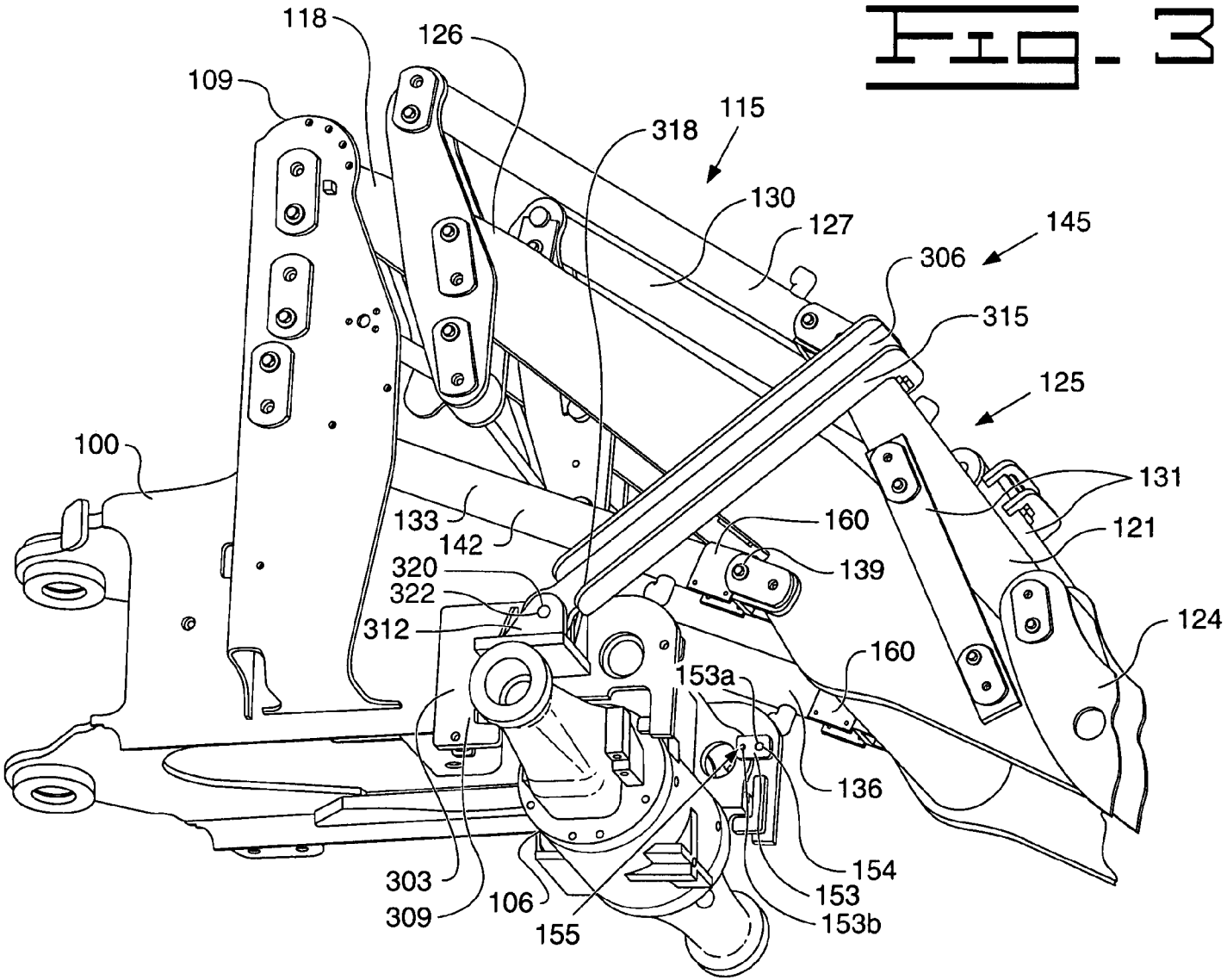
FIG. 3 is a diagrammatic side view of the linkage assembly of the work machine with an alternate embodiment of the restraints attached to the chassis and linkage assembly of the work machine.

Depicted in FIG. 3 is an alternate embodiment wherein the restraints 145 include coupling members 303 and hook members 306, the second-end portions 151 being the coupling members 303 and the first-end portions 148 being the hook members 306. The coupling members 303, having first-end portions 309 and second-end portions 312, have their first-end portions 309 removably attached to the chassis 100 of the work machine, or more particularly, to that portion of the chassis 100 that comprises the axle 106 as described above. Alternatively, the coupling member 303 may be attached to the chassis 100 or axle 106 by such process as welding. Further, the second-end portions 312 have apertures (not shown); the apertures being threaded so as to accept a mating bolt 322. The hook members 306 have first-end portions 315 and second-end portions 318. The second-end portions 318 of the hook members 306 have apertures 320 and are removably attached to the second-end portions 312 of the coupling members 303 by the use of fasteners, such as bolts 322 sized to fit within the apertures of the coupling member 303 and the apertures 320 of the hook members 306 and are threaded to mate with the threads of the apertures of the coupling member 303. Finally, the second-end portions 315 of the hook members 306 are removably attached to the linkage assembly 115 as described above.

INDUSTRIAL APPLICABILITY

The restraints 145 and the collars 160 lock the linkage assembly 115, including the lift arm 126 and the tilt linkage assembly 125, in a predetermined position preventing it from traveling from that position. In other words, the restraints 145 restrain the linkage assembly 115, and in particular, the lift arm 126, from any substantial up and down travel and restrains the tilt linkage assembly 125 from any tilting function. The restraints 145 are removably attached to the work machine by attaching the second-end portions 151 of the restraints 145 to the chassis 100, or more particularly, to that portion of the chassis 100 that comprises the axle 106, by using the brackets 153 and bolts 154, 155 and then attaching the first-end portions 148 of the restraints 145 to the linkage assembly 115 by having the hooks 255 fit over the linkage assembly 115 and having the bolts 256 threaded through the apertures 257 in the hooks 255. Finally, the collars 160 are removably attached to the hydraulic cylinders 133, 136 by placing the collars 160 on the rod ends 139 of the hydraulic cylinders 133, 136 abutting against the cylinder ends 142 and attaching them thereto. The collars 160 prevent the hydraulic cylinders 133, 136 from floating, or more particularly, the collars 160 prevent the hydraulic cylinders 133, 136 from compressing the rod ends 139 thereof toward the cylinder ends 142. This prevents the linkage assembly 115, and more particular, the lift arm 126, from substantial travel, or more specifically, lowering, especially when a load is placed thereon. Additionally, because the restraints 145 are removably attached to that portion of the linkage assembly 115 that comprises the tilt linkage assembly 125, the restraints 145 prevent substantial travel of the tilt linkage assembly 124, or more particularly, the tilt function.

To remove the restraints 145, the bolts 256 are unthreaded and removed from the apertures 257 in the hooks 255 of the first-end portions 148. The bolts 154 and 155 are unthreaded and removed from the bracket 153. The hooks 255 are then lifted off of the linkage assembly 115 and the restraints 145 are removed.

In the alternate embodiment, the restraints 145 are removably attached to the work machine as described above. Except however, the coupling members 303 and the hook members 306 are removably attached to one another by the use of bolts 322 being inserted into the apertures 320 and being threaded into the threaded apertures of the coupling member 303. To remove the restraints 145 of this embodiment, the bolts 256 are unthreaded and removed from the apertures 257 in the second-end portions 315 of the hook members 306. Then the bolts 322 are unthreaded from the apertures of the coupling members 303 and the apertures 320 of the hook members 306. The hook members 306 are lifted off the linkage assembly 115 and are removed therefrom. The coupling members 303 remain out of the way of the operation of the work machine and, therefore, can remain attached to the axle 106. The coupling members 303 can then even be used to lock the work machine in place during transportation thereof. To reattach the restraints 145 in this embodiment, only the hook members 306 need be attached to the coupling members 303 and the linkage assembly 115, as previously described.

It should be understood that the removable attachment of the first-end portions 148 and the second-end portions 151 of the restraints 145 and removable attachment of the collars 160 does not need to occur in any specific order. In addition, the attachment of the coupling members 303 and the hook members 306 may occur in any order. Once the linkage assembly 115 is in the predetermined position and the restraints 145 and collars 160 are attached, any loads placed on the linkage assembly 115, including the lift arm 126 and the tilt linkage assembly 125, during operation of the work machine are transferred through the restraints 145 to the chassis 100 of the work machine, or more particularly, through the restraints 145 to the axles 106 of the work machine. The restraints 145 help prevent shock loads from being placed on the linkage assembly 115, including the cylinders 127, 130, 133, 136, the lift arm 126, and the tilt linkage assembly 125. This may help prevent damage to those components of the work machine. For example, if a very heavy implement 124 is attached to the linkage assembly 115, it may be appropriate to restrain the linkage assembly 115 to prevent damage to the linkage assembly 115, including the cylinders 127, 130, 133, 136, the lift arm 126, and the tilt linkage assembly 125, and to prevent the work machine from tipping. Additionally, the restraints 145 may be used to restrain the linkage assembly 115 for other purposes, such as convenience, efficient operation of the work machine or the implement 124, to keep the implement 124 in a particular position, etc.

Other aspects, objects and advantages of the invention can be obtained from a study of the drawings, the disclosure and the appended claims.

What is claimed is:

1. A work machine comprising:

a chassis;

at least one linkage assembly attached to the work machine; and at least one restraint having a first-end portion and a second-end portion, the second-end portion being attached to the chassis and the first-end portion being structured to fit over the linkage assembly so as to removably attach the first-end portion above the linkage assembly, the restraint transferring a load from the linkage assembly to the chassis.

2. The work machine of claim 1, further comprising:

at least one actuator having a first-end portion and a second-end portion, the first-end portion of the actuator being attached to the linkage assembly and the second-end portion of the actuator being attached to the work machine; and at least one collar being attached to the actuator.

3. The work machine of claim 2, wherein the linkage assembly further comprises:

at least one lift arm; and at least one tilt linkage assembly.

4. The work machine of claim 3, wherein the restraint prevents substantial travel of the lift arm and the tilt linkage assembly.

5. The work machine of claim 1, further comprising an axle attached to the chassis, the second-end portion of the restraint being attached to the axle.

6. The work machine of claim 1, wherein the second-end portion of the restraint is removably attached to the chassis.

7. The work machine of claim 1, wherein the restraint comprises at least one coupling member and at least one hook member, the second-end portion of the restraint being the coupling member and the first-end portion of the restraint being the hook member.

8. A method of restraining at least one linkage assembly of a work machine, the work machine having a chassis, at a predetermined position, the method comprising:

providing at least one restraint having a first-end portion and a second-end portion;

moving the linkage assembly to the predetermined position;

attaching the second-end portion of the restraint to the chassis of the work machine;

attaching the first-end portion of the restraint over the linkage assembly so as to removably attach the first-end portion above the linkage assembly;

substantially restraining the linkage assembly from traveling from the predetermined position; and transferring a load from the linkage assembly to the chassis through the restraint.

9. The method of claim 8, further comprising:

providing at least one actuator with a first-end portion and a second-end portion;

attaching the first-end portion of the actuator to the linkage assembly;

attaching the second-end portion of the actuator to the work machine; and attaching at least one collar to the actuator.

10. The method of claim 9, wherein the linkage assembly further comprises:

at least one lift arm; and at least one tilt linkage assembly.

11. The method of claim 10, wherein substantially restraining the linkage assembly further comprises substantially restraining travel of the lift arm and the tilt linkage assembly.

12. The method of claim 9, further comprising:

providing the work machine with an axle attached to the chassis; and attaching the second-end portion of the restraint to the axle of the work machine.

13. A work machine comprising:

a chassis;

at least one linkage assembly pivotally attached to the chassis; and at least one restraint having a first-end portion and a second-end portion, the first-end portion being structured to fit over the linkage assembly so as to removably attach the first-end portion above the linkage assembly and the second-end portion being attached to the chassis, the restraint preventing any substantial travel of the linkage assembly.

14. The work machine of claim 13, wherein the linkage assembly further comprises:

at least one lift arm; and at least one tilt linkage assembly.

15. The work machine of claim 14, wherein the restraint prevents substantial travel of the lift arm and the tilt linkage assembly.

16. The work machine of claim 13, wherein the restraint transfers a load from the linkage assembly to the chassis.

17. The work machine of claim 13, further comprising an axle attached to the chassis, the second-end portion of the restraint being attached to the axle.

18. The work machine of claim 17, wherein the restraint transfers a load from the linkage assembly to the axle.

19. A work machine comprising:

a chassis;

at least one linkage assembly attached to the work machine;

at least one restraint having a first-end portion and a second-end portion, the second-end portion being attached to the chassis and the first-end portion being attached to the linkage assembly, the restraint transferring a load from the linkage assembly to the chassis; and wherein the restraint comprises at least one coupling member and at least one hook member, the second-end portion of the restraint being the coupling member and the first-end portion of the restraint being the hook member.

* * * * *